US005339797A

United States Patent [19]

Maitland

[11] Patent Number: 5,339,797

[45] Date of Patent: Aug. 23, 1994

[54] FIREPLACE AND METHOD FOR COOLING SAME

[75] Inventor: Kenneth R. Maitland, Huntington, Ind.

[73] Assignee: Majco Building Specialties, L.P., Huntington, Ind.

[21] Appl. No.: 18,039

[22] Filed: Feb. 16, 1993

[51] Int. Cl.[5] ..... F24B 1/188

[52] U.S. Cl. ..... 126/528; 126/500; 126/523; 126/80; 126/312

[58] Field of Search ..... 126/528, 500, 523, 529, 126/532, 80, 312, 307 R

[56] References Cited

U.S. PATENT DOCUMENTS

| | | | |
|---|---|---|---|
| 171,773 | 1/1876 | Bussell . | |
| 274,567 | 3/1883 | Cummings . | |
| 2,002,879 | 5/1935 | Blakeman . | |
| 2,703,567 | 3/1955 | Manchester et al. | 126/531 |
| 2,718,841 | 9/1955 | Kinkead . | |
| 3,190,281 | 6/1965 | Northwood . | |
| 3,601,117 | 8/1971 | Carson . | |
| 3,623,458 | 11/1971 | Block . | |
| 4,319,556 | 3/1982 | Schwartz et al. | 126/77 |
| 4,335,704 | 6/1982 | Wingstrom et al. | 126/293 |
| 4,519,376 | 5/1985 | Schoeff et al. | 126/121 |
| 4,793,322 | 12/1988 | Shimek et al. | 126/80 |
| 5,016,613 | 5/1991 | Maitland | 126/312 |

*Primary Examiner*—Larry Jones
*Attorney, Agent, or Firm*—Baker & Daniels

[57] ABSTRACT

A fireplace having a bottom wall, inner top wall, two side walls and rear wall defines a combustion chamber having a front opening. An outer top wall is disposed above the inner top wall. The outer top wall and the inner top wall are disposed in spaced apart relationship relative to each other and define an air flow channel therebetween having an inlet. The outer top wall is an upper exterior surface of the fireplace and includes a first nozzle member. The inner top wall is an upper interior surface of the combustion chamber and includes a second nozzle member. A chimney flue is attached to the outer top wall. The first and second nozzle members are in fluid communication with the chimney flue and define a converging nozzle therebetween inducing a flow of cooling air in the air flow channel.

21 Claims, 2 Drawing Sheets

FIREPLACE AND METHOD FOR COOLING SAME

BACKGROUND OF THE INVENTION

1. Field of the Invention

The present invention relates to fireplaces, and, more particularly, to fireplaces inducing a flow of cooling air above the primary combustion chamber.

2. Description of the Related Art

A fireplace may be designed to be built into a wall during the construction of a new building. Because the fireplace is necessarily in proximity to certain combustible building products, e.g., wood, the temperature at a location a specified distance from the exterior of the fireplace should not exceed a predetermined relative temperature with respect to an ambient temperature, in accordance with certain standards in the industry. For example, in accordance with Underwriters Laboratory Standard U.L. 127, Standard for Factory Built Fireplaces (6th Ed., 1988), which is incorporated herein by reference, the predetermined relative temperature (e.g., 90° F. or 140° F. above an ambient temperature) is measured at a specified distance from the exterior of the fireplace (e.g., ½ inch) at the surface of a combustible building product.

It is known in the art to circulate air via a natural draft in an air flow duct disposed across the bottom, back and top of a fireplace and exhaust the cooling air into the combustion chamber. The cooling air reduces the exterior surface temperature of the fireplace, enhances secondary combustion within the combustion chamber and is exhausted up the chimney flue to the environment- A problem with such a design, however, is that radiant heat rising from the combustion chamber collides with the flow of cooling air and obstructs the flow of cooling air into the combustion chamber. Because the flow of cooling air is impeded from entry into the combustion chamber, the flow of cooling air across the bottom, back and top of the fireplace is likewise impeded. Decreased flow of cooling air across the bottom, back, and top of the fireplace results in decreased heat transfer via convection in the air flow conduit directly adjacent the combustion chamber and results in a higher exterior surface temperature of the fireplace- Therefore, what is needed in the art is a fireplace which causes an adequate flow of cooling air through the fireplace exterior of the primary combustion chamber.

As a result of the decreased cooling air flow and heat transfer, insulation is typically provided at strategic locations directly adjacent the exterior of the fireplace to maintain the temperature at a location a specified distance from the exterior of the fireplace below a predetermined temperature relative to an ambient temperature. Insulation disposed above the combustion chamber increases the height of the fireplace. Accordingly, what is needed in the art is a fireplace which does not utilize insulation above the primary combustion chamber and maintains the temperature at a location a specified distance from the exterior of the fireplace below a predetermined temperature relative to an ambient temperature. A further need is a fireplace which reduces the height of the fireplace above the combustion chamber.

It is also known in the art to induce a flow of cooling air in a conduit disposed above the primary combustion chamber for cooling the exterior of the fireplace. Such a fireplace is disclosed in U.S. Pat. No. 5,016,613, issued to the present inventor, which is assigned to the assignee of the present invention and incorporated herein by reference. In general, a primary wall and secondary wall disposed above the combustion chamber define a converging nozzle therebetween which induces a flow of cooling air which is exhausted into the chimney flue. Disposed above the secondary wall, between the secondary wall and upper exterior of the fireplace, is a dead air space. Insulation is attached to the exterior of the fireplace above the secondary wall to maintain the temperature at a location a specified distance from the exterior of the fireplace below a predetermined relative temperature with respect to an ambient temperature. The air flow conduit defined by the primary wall and secondary wall acts to decrease the exterior surface temperature of the fireplace.

Over a period of time, however, the temperature of the stagnant air between the secondary wall and exterior of the fireplace increases. Insulation attached to the exterior of the fireplace above the secondary wall is needed to maintain the temperature at a location a specified distance from the exterior of the fireplace below a predetermined temperature relative to an ambient temperature. U.S. Pat. No. 5,016,613 therefore is a step forward in the art toward reducing the exterior surface temperature of a fireplace, but still requires insulation to maintain the aforementioned relative temperature below a predetermined limit.

It may also be possible to reduce the exterior surface temperature of a fireplace without the use of insulation. For example, in applications where the size of the fireplace is not a prohibiting factor, a conduit may be formed around the bottom, back and top of the fireplace for circulating a flow of air, i.e., such as in a room air circulating fireplace. Such fireplaces use a forced flow of air to heat the room in which the fireplace is located. What is needed in the art is a fireplace having an adequate flow of cooling air through the fireplace exterior of the primary combustion chamber without additional hardware, such as a blower, for causing the flow of cooling air.

SUMMARY OF THE INVENTION

The present invention provides a fireplace having a inner top wall and an outer top wall defining an air flow channel and a converging nozzle. The outer top wall is an exterior wall of the fireplace. The converging nozzle induces a flow of cooling air from the ambient environment through the air flow channel.

In general, the inner top wall and outer top wall are disposed in spaced apart relationship. Insulation is not provided above the combustion chamber on either the inner top wall or outer top wall. The outer top wall and inner top wall respectively include a first and second nozzle member defining a converging nozzle therebetween. The converging nozzle is in fluid communication with the chimney flue and induces a flow of cooling air between the outer top wall and inner top wall, thereby maintaining the temperature at a location a specified distance from the exterior of the fireplace below a predetermined relative temperature with respect to an ambient temperature.

The invention comprises, in one form thereof, a fireplace having a bottom wall, inner top wall, two side walls and rear wall defining a combustion chamber having a front opening. An outer top wall is disposed above the inner top wall. The outer top wall and the inner top wall are disposed in spaced apart relationship relative to each other and define an air flow channel therebetween having an inlet. The outer top wall is an upper exterior surface of the fireplace and includes a first nozzle member. The inner top wall is an upper interior surface of the combustion chamber and includes a second nozzle member. A chimney flue is attached to the outer top wall. The first and second nozzle members are in fluid communication with the chimney flue and define a converging nozzle therebetween inducing a flow of cooling air in the air flow channel.

Utilizing the lower pressure region formed by the converging nozzle to induce a flow of cooling air across the bottom and at least one of the sides or back of the fireplace for cooling the same provides advantages over known devices. For example, exhausting the flow of cooling air from the sides and/or back of the fireplace directly to the chimney, rather than into the combustion chamber as heretofore known, results in a relatively unobstructed flow of cooling air for more efficiently cooling the exterior surfaces of the fireplace. Because of the improved cooling caused by the unobstructed flow of cooling air, the air flow duct at the bottom and back and/or sides of the fireplace may be reduced in size, thereby decreasing the overall size of the fireplace.

Another advantage is that industry standard U.L. 127 can be complied with without the use of insulation in the fireplace above the combustion chamber.

An additional advantage is that an adequate flow of cooling air is provided through the fireplace exterior of the primary combustion chamber without additional hardware, such as a blower.

A further advantage is that the height of the fireplace above the combustion chamber may be decreased relative to conventional fireplaces because of the lack of required insulation.

A still further advantage is that the height of the fireplace above the combustion chamber is reduced.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention and such exemplification is not to be construed as limiting the scope of the invention in any manner.

DETAILED DESCRIPTION OF THE INVENTION

Figure 1:
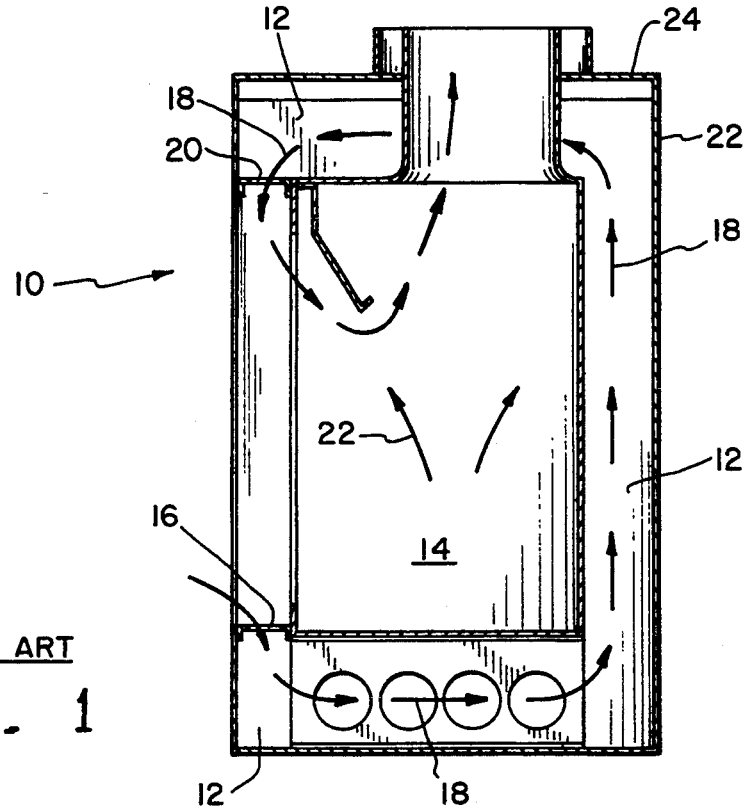
PRIOR ART FIG. 1
FIG. 1 is a side sectional view of a conventional fireplace circulating cooling air across the bottom, back and top of the fireplace with the cooling air exhausting into the primary combustion chamber.
Figure 2:
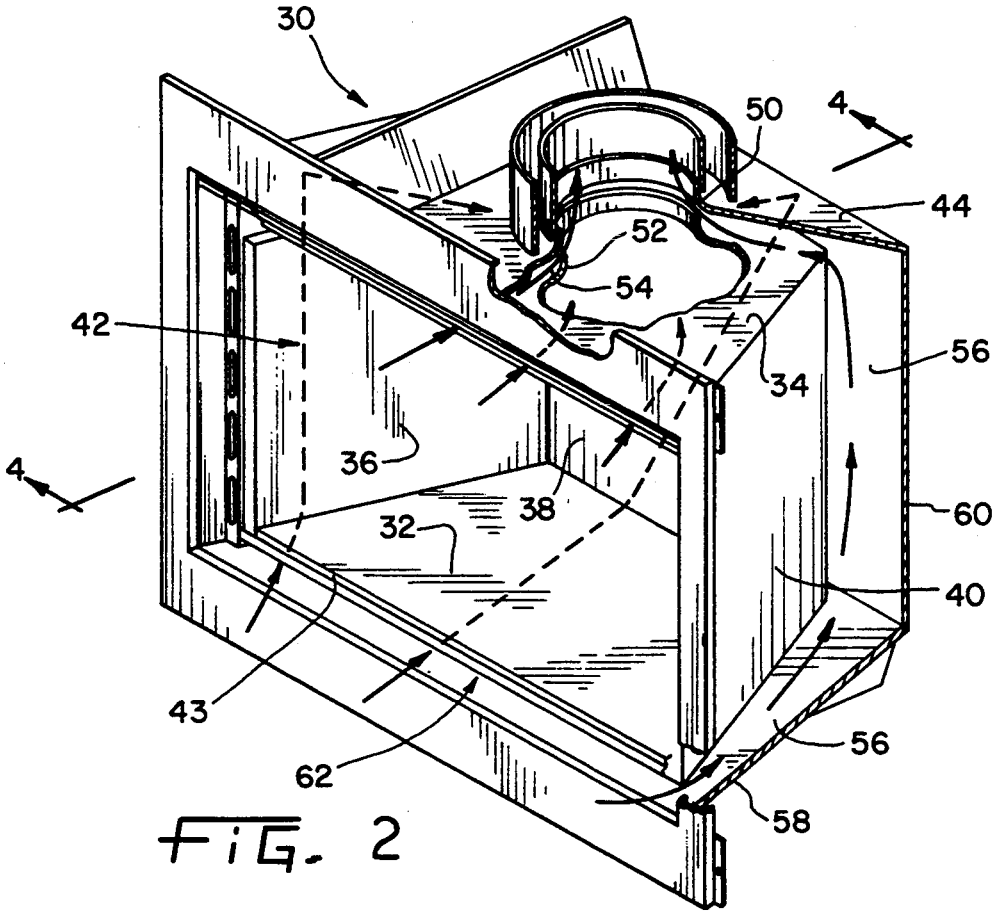
FIG. 2 is a perspective view of a fireplace according to an embodiment of the present invention with portions broken away to illustrate the details of construction.
Figure 3:
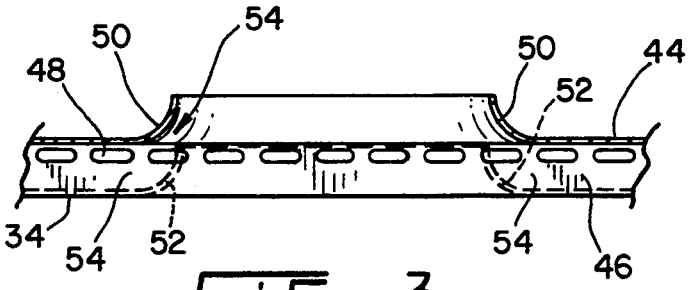
FIG. 3 is an enlarged fragmentary front view of the fireplace shown in FIG. 2.
Figure 4:
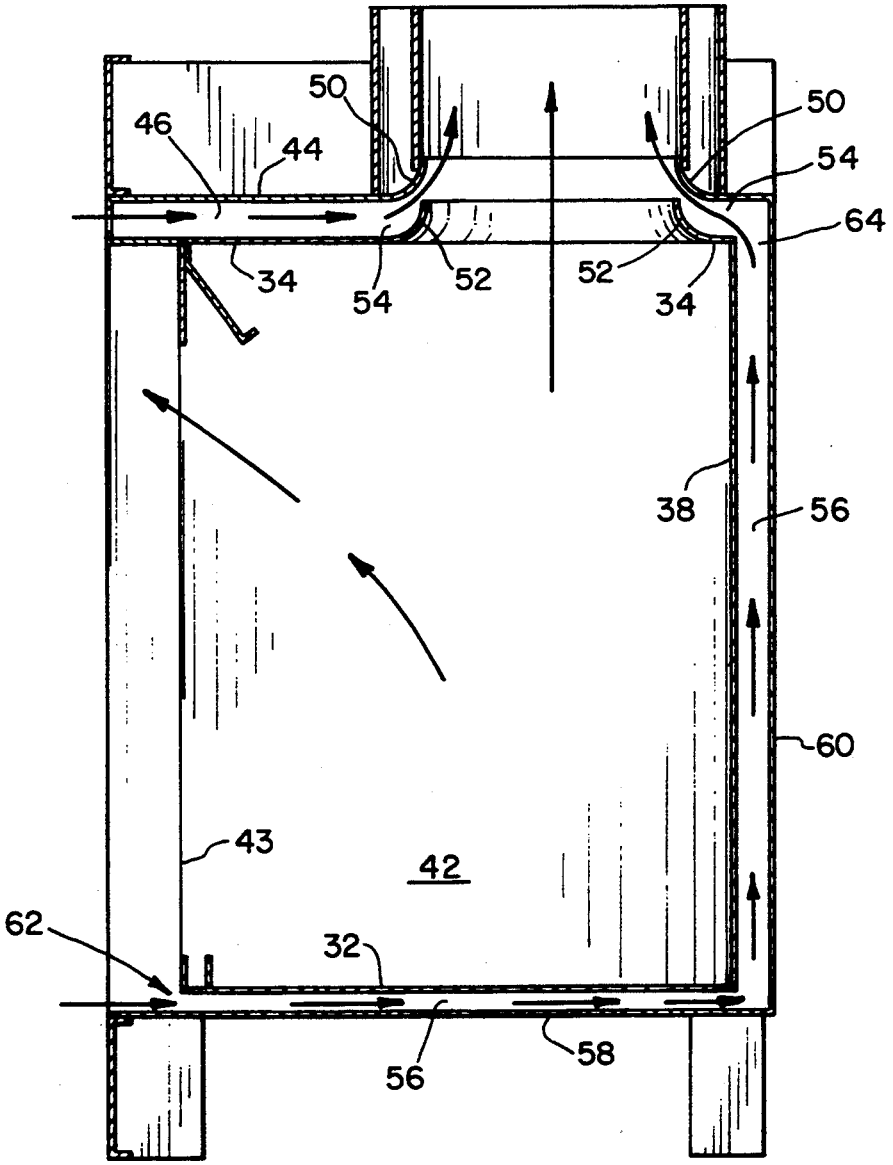
FIG. 4 is a sectional view of the fireplace shown in FIG. 2 taken along line 4—4.

Referring now to the drawings and particularly to FIG. 1, there is shown a fireplace 10 of conventional design having an air flow conduit 12 disposed around the bottom, back and top of primary combustion chamber 14. Cooling air is drawn in at the bottom of the fireplace through inlet 16 and flows via natural draft around the bottom, back and top of the fireplace (as shown by directional arrows 18) before entering combustion chamber 14 via outlet 20. As the cooling air flows through outlet 20, a portion of the hot gases of combustion rising from combustion chamber 14 collide with cooling air flowing through outlet 20, as indicated by directional arrow 22. The collision of rising combustion products from combustion chamber 14 with the flow of cooling air not only inhibits the flow of cooling air into combustion chamber 14, but further reduces the flow rate of cooling air through air flow conduit 12. This decreased air flow through air flow conduit 12 reduces the convection heat transfer efficiency of the cooling air and causes an increase in temperature at an exterior surface of fireplace 10, such as at exterior back wall 22 and outer top wall 24. Conventional fireplace 10 therefore includes a flow of cooling air through air flow conduit 12 which is impeded because of hot rising combustion products within combustion chamber 14.

In accordance with the present invention, a fireplace 30 includes a bottom wall 32, inner top wall 34, rear wall 38, and sidewalls 36 and 40 defining a combustion chamber 42 having a front opening 43. Disposed above inner top wall 34 is an outer top wall 44 which comprises an upper exterior surface of fireplace 30. Inner top wall 34 and outer top wall 44 are disposed in spaced apart relationship relative to each other and define an air flow channel 46 therebetween. Air flow channel 46 is disposed directly adjacent outer top wall 44 and extends substantially across the entire portion of fireplace 30 above combustion chamber 42 (i.e., except for the portion of fireplace 30 radially inward of second nozzle member 52). A plurality of air inlets 48 disposed at the front and top of fireplace 30 are in fluid communication with and allow ambient air to enter into air flow channel 46.

Outer top wall 44 and inner top wall 34, respectively, define first and second nozzle members 50 and 52 which are in fluid communication with combustion chamber 42. First nozzle member 50 has an inside diameter which is larger than the inside diameter of second nozzle member 52. First and second nozzle members 50 and 52 are disposed in a generally vertical and coaxial relationship relative to each other. First and second nozzle members 50 and 52 each define a curved flange portion respectively adjoining outer top wall 44 and inner top wall 34, and defining a converging nozzle 54 therebetween. Converging nozzle 54 provides a region of lower pressure and functions as an outlet for air flow channel 46 by inducing a flow of air across air flow channel 46 because of the pressure differential at converging nozzle 54.

Disposed at the bottom and back of fireplace 30 is an air flow duct 56 defined by bottom wall 32 and rear wall 38, and exterior bottom wall 58 and exterior rear wall 60. Cooling air flows through an inlet 62 provided at the front and bottom of fireplace 30 via natural draft through air flow duct 56. Outlet 64 of air flow conduit 56 is in fluid communication with air flow channel 46 disposed above combustion chamber 42. The region of lower pressure formed at converging nozzle 54 further enhances the flow of cooling air through air flow conduit 56.

It is apparent from the drawings that in contrast with the conventional fireplace shown in FIG. 1, which requires insulation at the top of the fireplace, fireplace 30 of the present invention does not require any insulation to comply with industry standard U.L. 127. Eliminating insulation at the top of a fireplace results in a fireplace having a decreased height above the combustion chamber. Material costs are consequently reduced because of the lesser amount of metal required, and because of the elimination of the insulation.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fireplace, comprising:

a bottom wall, inner top wall, two side walls and rear wall defining a combustion chamber having a front opening;

an outer top wall disposed above said inner top wall, said outer top wall and said inner top wall disposed in spaced apart relationship relative to each other and defining an air flow channel therebetween having an inlet, said outer top wall comprising an upper exterior surface of said fireplace and including a first nozzle member, said inner top wall comprising an upper interior surface of said combustion chamber and including a second nozzle member; and a chimney flue attached to said outer top wall;

said first and second nozzle members in fluid communication with said chimney flue and defining a converging nozzle therebetween inducing a flow of cooling air in said air flow channel.

2. The fireplace of claim 1, wherein each of said first and second nozzle members comprise a curved flange portion, said curved flange portions defining said converging nozzle.

3. The fireplace of claim 1, wherein said first and second nozzle members are disposed in a generally vertical and coaxial relationship relative to each other.

4. The fireplace of claim 1, wherein said inlet is disposed at the front of said fireplace.

5. A fireplace, comprising:

a bottom wall, inner top wall, two side walls and rear wall defining a combustion chamber having a front opening;

an outer top wall disposed above said inner top wall, said outer top wall and said inner top wall disposed in spaced apart relationship relative to each other and defining an air flow channel therebetween having an inlet, said outer top wall including a first nozzle member and said inner top wall including a second nozzle member; and a chimney flue attached to said outer top wall;

said first and second nozzle members in fluid communication with said chimney flue and defining a converging nozzle therebetween inducing a flow of cooling air between said outer and inner top wall members, said flow of cooling air maintaining a temperature at a location a specified distance from the exterior of said outer top wall below a predetermined relative temperature with respect to an ambient temperature;

there being an absence of insulating material on the exterior of said outer wall.

6. The fireplace of claim 5, wherein each of said first and second nozzle members comprise a curved flange portion, said curved flange portions defining said converging nozzle.

7. The fireplace of claim 5, wherein said predetermined relative temperature comprises 90° F. above the ambient temperature.

8. The fireplace of claim 5, wherein said predetermined relative temperature comprises 140° F. above the ambient temperature.

9. The fireplace of claim 5, wherein said first and second nozzle members are disposed in a generally vertical and coaxial relationship relative to each other.

10. The fireplace of claim 5, wherein said inlet is disposed at the front of said fireplace.

11. A method of cooling the exterior of a fireplace, comprising the steps of:

providing an air flow channel above a combustion chamber of said fireplace substantially across and directly adjacent the entire upper exterior of said fireplace, said air flow channel consisting of a metal inner top wall and a metal outer top wall, said metal outer top wall comprising an upper exterior surface of said fireplace, said air flow channel having an outlet in fluid communication with a chimney flue disposed above said combustion chamber;

defining a region of lower pressure at said air flow channel outlet for inducing a flow of cooling air through said air flow channel; and maintaining a temperature at a location a specified distance from the exterior of said fireplace below a predetermined temperature relative to an ambient temperature.

12. The method of claim 11, wherein the predetermined relative temperature comprises 90° F. above said ambient temperature at a location which is ½ inch from an exterior rear wall of said fireplace.

13. The method of claim 11, wherein said predetermined relative temperature comprises 140° F. above said ambient temperature at a location which is ½ inch from an exterior rear wall of said fireplace.

14. A fireplace, comprising:

a bottom wall, inner top wall, two side walls and rear wall defining a combustion chamber having a front opening;

an outer top wall disposed above said inner top wall, said outer top wall and said inner top wall disposed in spaced apart relationship relative to each other and defining an air flow channel therebetween having an inlet, said outer top wall including a first nozzle member, said inner top wall comprising an upper interior surface of said combustion chamber and including a second nozzle member;

a chimney flue attached to said outer top wall; said first and second nozzle members in fluid communication with said chimney flue and defining a converging nozzle therebetween including a flow of cooling air in said air flow channel; and an air flow duct disposed adjacent said bottom wall and at least one of said side walls and rear wall, said air flow duct having an inlet and outlet, said air flow duct outlet disposed in fluid communication with said chimney flue, said converging nozzle further inducing a flow of air through said air flow conduit.

15. The fireplace of claim 14, wherein each of said first and second nozzle members comprise a curved flange portion, said curved flange portions defining said converging nozzle.

16. The fireplace of claim 14, wherein said first and second nozzle members are disposed in a generally vertical and coaxial relationship relative to each other.

17. The fireplace of claim 14, wherein said outer top wall comprises an upper exterior surface of said fireplace.

18. The fireplace of claim 14, wherein said air flow duct inlet is disposed at the front of said fireplace.

19. The fireplace of claim 14, wherein said air flow channel inlet is disposed at the front of said fireplace.

20. The fireplace of claim 14, wherein said air flow duct is disposed adjacent said bottom wall, two side walls and rear wall.

21. The fireplace of claim 20, wherein said air flow duct outlet is in fluid communication with said air flow channel.

* * * * *